US009822776B2

(12) United States Patent
Pop

(10) Patent No.: US 9,822,776 B2
(45) Date of Patent: Nov. 21, 2017

(54) DETECTING AND COMPENSATING FOR THE EFFECTS OF PUMP HALF-STROKING

(71) Applicant: Schlumberger Technology Corporation, Sugar Land, TX (US)

(72) Inventor: Julian Pop, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 435 days.

(21) Appl. No.: 14/464,440

(22) Filed: Aug. 20, 2014

(65) Prior Publication Data

US 2016/0053607 A1 Feb. 25, 2016

(51) Int. Cl.
*F04B 47/00* (2006.01)
*E21B 49/10* (2006.01)

(52) U.S. Cl.
CPC ..... *F04B 47/00* (2013.01); *E21B 49/10* (2013.01)

(58) Field of Classification Search
CPC ..... E21B 49/00; E21B 49/08; E21B 49/081; E21B 2049/085; E21B 49/10; E21B 49/083; E21B 49/082
See application file for complete search history.

(56) References Cited

U.S. PATENT DOCUMENTS 5,635,631 A * 6/1997 Yesudas ..... E21B 49/008 73/152.18
8,757,986 B2 6/2014 Villareal et al.
9,303,509 B2 * 4/2016 Milkovisch ..... E21B 49/008
2004/0231842 A1 * 11/2004 Shammai ..... E21B 49/008 166/264
2006/0175090 A1 8/2006 Reitsma et al.
2007/0246263 A1 10/2007 Reitsma
2008/0173454 A1 7/2008 Smithson et al.
2010/0169020 A1 * 7/2010 Niu ..... E21B 49/008 702/13
2010/0175873 A1 * 7/2010 Milkovisch ..... E21B 49/008 166/264
2013/0022476 A1 1/2013 Villareal et al.
2013/0248173 A1 9/2013 Ross et al.
2014/0131037 A1 5/2014 Hsu et al.
2015/0322767 A1 * 11/2015 Samuel ..... E21B 44/04 175/27

OTHER PUBLICATIONS

International Search Report and Written Opinion issued in related PCT application PCT/US2015/041098 dated Apr. 25, 2016, 8 pages.
Villareal et al. "Characterization of Sampling While Drilling Operations," IADC/SPE 128249, IADC/SPE Drilling Conference and Exhibition, New Orlean, Louisiana, USA, Feb. 2-4, 2010.
U.S. Appl. No. 14/135,979, filed May 5, 2014.

* cited by examiner

*Primary Examiner* — Kipp Wallace

(57) ABSTRACT

Various methods for detecting and accounting for the effects of half-stroking by a pump are provided. In one embodiment, a method includes operating a pump of a downhole tool to pump fluid from a formation through the downhole tool and determining pressure differentials between a formation pressure and pressure of the fluid within the downhole tool. The pressure differentials for each of a forward stroke and reverse stroke of the pump can be summed and then compared to enable identification of onset of half-stroking by the pump. Additional systems, devices, and methods are also disclosed.

18 Claims, 8 Drawing Sheets

DETECTING AND COMPENSATING FOR THE EFFECTS OF PUMP HALF-STROKING

BACKGROUND

Wells are generally drilled into subsurface rocks to access fluids, such as hydrocarbons, stored in subterranean formations. The formations penetrated by a well can be evaluated for various purposes, including for identifying hydrocarbon reservoirs within the formations. During drilling operations, one or more drilling tools in a drill string may be used to test or sample the formations. Following removal of the drill string, a wireline tool may also be run into the well to test or sample the formations. These drilling tools and wireline tools, as well as other wellbore tools conveyed on coiled tubing, drill pipe, casing or other means of conveyance, are also referred to herein as "downhole tools." Certain downhole tools may include two or more integrated collar assemblies, each for performing a separate function, and a downhole tool may be employed alone or in combination with other downhole tools in a downhole tool string.

Formation evaluation can involve drawing fluid from the formation into a downhole tool. A pump in the downhole tool can be used to initiate a drawdown to cause fluid to enter the downhole tool from the formation, to route this formation fluid within the tool, and to expel the fluid into the wellbore. Once drawn from the formation, the fluid can be analyzed within the tool or samples of the fluid can be stored within the tool for later analysis. In some instances, downhole tools include pumps having reciprocating pistons for drawing formation fluid into the tool and check valves are used to maintain flow of the formation fluid in a desired direction through the tool. During normal pump operation, the volume of fluid drawn from the formation can be generally calculated based on the volume of fluid displaced by the piston. Malfunctioning of one or more check valves in the tool, however, can result in half-stroking of the pump. During half-stroking, the ability of the pump to draw fluid from the formation is impaired and the volume of fluid actually drawn from the formation is less than the volume of fluid displaced by the piston.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In one embodiment of the present disclosure, a method includes operating a pump of a downhole tool to pump fluid from a formation through the downhole tool. The method also includes determining pressure differentials between a formation pressure and pressure of the fluid within the downhole tool. Determined pressure differentials can be summed for a forward stroke of the pump and for a reverse stroke of the pump. These summed pressure differentials for the forward and reverse strokes can be compared to enable identification of onset of half-stroking by the pump.

In another embodiment, a method includes drawing fluid through a flowline from a pressurized source into a first chamber of a pump, and expelling fluid from a second chamber of the pump, by moving a piston of the pump in a first direction. The direction of movement of the piston can be changed from the first direction to a second, opposite direction. Fluid can then be drawn through the flowline from the pressurized source into the second chamber of the pump, and fluid can be expelled from the first chamber of the pump, by moving the piston in the second direction. The method also includes monitoring flowline pressure of the fluid drawn from the source and determining pressure differentials between the flowline and the source. The volume of fluid pumped by the pump can then be computed based on the determined pressure differentials.

Another embodiment includes an apparatus including a downhole tool having an intake for receiving formation fluid within a flowline of the downhole tool. This downhole tool also includes a pump connected to the flowline so that the pump can draw the formation fluid into the downhole tool through the flowline and expel the formation fluid from the downhole tool. A sensor of the downhole tool can measure formation fluid pressure within the flowline. The apparatus also includes a controller for determining pressure differentials between a formation pressure and measured formation fluid pressure within the flowline, comparing aggregates of the pressure differentials for consecutive strokes of the pump, and identifying onset of half-stroking by the pump based on the comparison of the aggregates of the pressure differentials for the consecutive strokes.

Various refinements of the features noted above may exist in relation to various aspects of the present embodiments. Further features may also be incorporated in these various aspects as well. These refinements and additional features may exist individually or in any combination. For instance, various features discussed below in relation to the illustrated embodiments may be incorporated into any of the above-described aspects of the present disclosure alone or in any combination. Again, the brief summary presented above is intended just to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

It is to be understood that the present disclosure provides many different embodiments, or examples, for implementing different features of various embodiments. Specific examples of components and arrangements are described below for purposes of explanation and to simplify the present disclosure. These are, of course, merely examples and are not intended to be limiting.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not mandate any particular orientation of the components.

The present disclosure generally relates to detecting and compensating for the effects of half-stroking during operation of a reciprocating pump. In at least some embodiments, the reciprocating pump is incorporated in a formation testing tool and used for drawing formation fluid into the tool. Evaluations of certain parameters during formation testing, such as the level of formation fluid contamination and predictions of time until reaching a desired contamination level (e.g., for capturing a clean fluid sample), depend on the volume of fluid drawn from the formation. Half-stroking by the pump has direct implications on the efficiency of the sampling operation. In some embodiments, a reciprocating pump of a downhole tool is operated to draw fluid from a formation into a flowline and pressure differentials between the formation pressure and the flowline pressure are determined. The pressure differentials for different strokes can be compared to identify the onset or cessation of half-stroking. In certain embodiments, the pressure differentials can be summed or otherwise aggregated for each of consecutive strokes of the reciprocating pump and then compared to one another to enable the detection of half-stroking. The pressure differentials can also be used in determining real-time mobility during the strokes and calculating the volume of fluid drawn from the formation by the pump in a manner that accounts for the effects of half-stroking.

Figure 1:
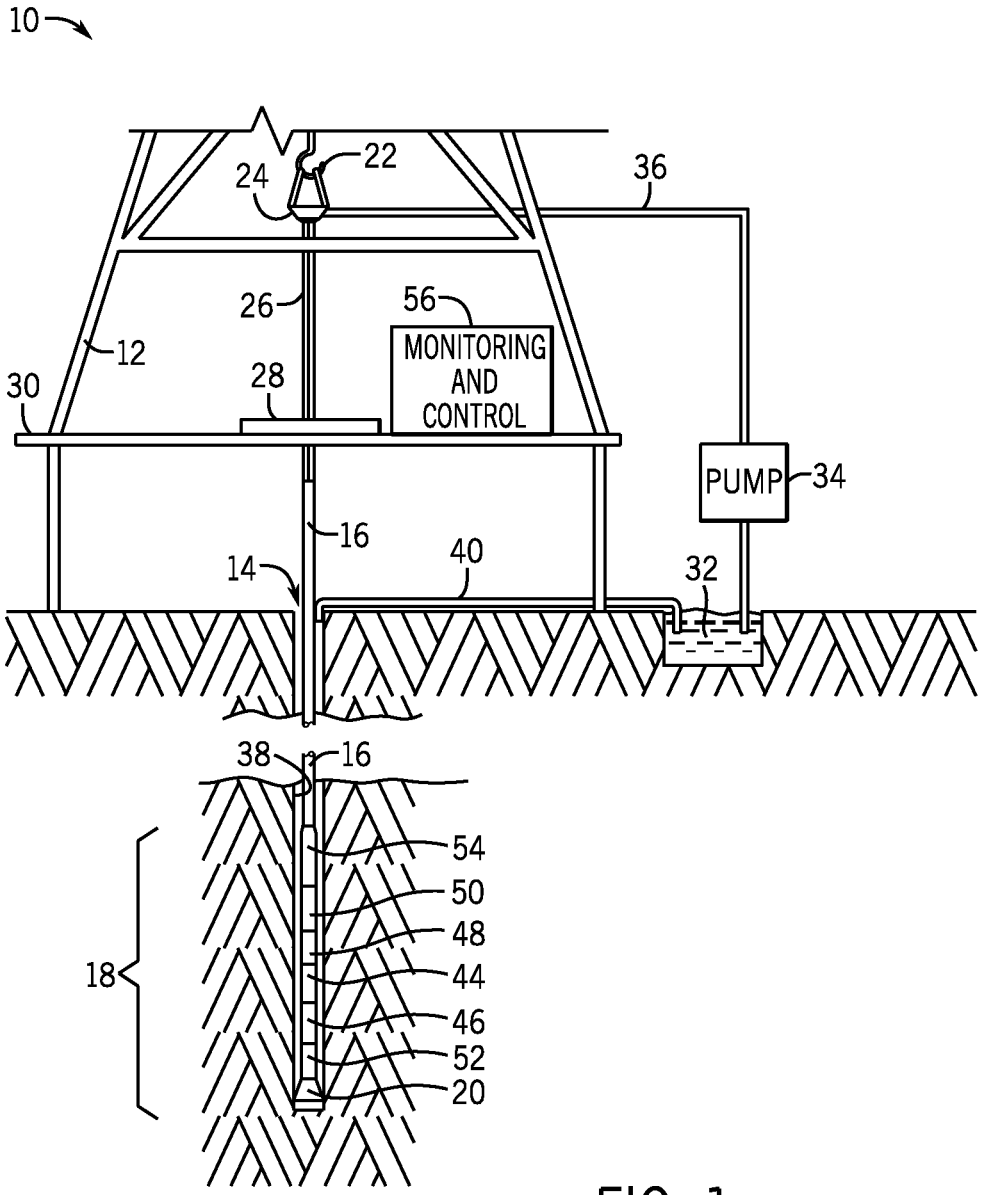
FIG. 1 generally depicts a drilling system having a testing tool in a drill string in accordance with one embodiment of the present disclosure.

As generally noted above, downhole tools are deployed in various ways to facilitate formation evaluation. By way of example, and now turning to the drawings, a drilling system 10 with such a downhole tool is depicted in FIG. 1 in accordance with one embodiment. While certain elements of the drilling system 10 are depicted in this figure and generally discussed below, it will be appreciated that the drilling system 10 may include other components in addition to, or in place of, those presently illustrated and discussed. As depicted, the system 10 includes a drilling rig 12 positioned over a well 14. Although depicted as an onshore drilling system 10, it is noted that the drilling system could instead be an offshore drilling system. The drilling rig 12 supports a drill string 16 that includes a bottomhole assembly 18 having a drill bit 20. The drilling rig 12 can rotate the drill string 16 (and its drill bit 20) to drill the well 14.

The drill string 16 is suspended within the well 14 from a hook 22 of the drilling rig 12 via a swivel 24 and a kelly 26. Although not depicted in FIG. 1, the skilled artisan will appreciate that the hook 22 can be connected to a hoisting system used to raise and lower the drill string 16 within the well 14. As one example, such a hoisting system could include a crown block and a drawworks that cooperate to raise and lower a traveling block (to which the hook 22 is connected) via a hoisting line. The kelly 26 is coupled to the drill string 16, and the swivel 24 allows the kelly 26 and the drill string 16 to rotate with respect to the hook 22. In the presently illustrated embodiment, a rotary table 28 on a drill floor 30 of the drilling rig 12 is constructed to grip and turn the kelly 26 to drive rotation of the drill string 16 to drill the well 14. In other embodiments, however, a top drive system could instead be used to drive rotation of the drill string 16.

During operation, drill cuttings or other debris may collect near the bottom of the well 14. Drilling fluid 32, also referred to as drilling mud, can be circulated through the well 14 to remove this debris. The drilling fluid 32 may also clean and cool the drill bit 20 and provide positive pressure within the well 14 to inhibit formation fluids from entering the wellbore. In FIG. 1, the drilling fluid 32 is circulated through the well 14 by a pump 34. The drilling fluid 32 is pumped from a mud pit (or some other reservoir, such as a mud tank) into the drill string 16 through a supply conduit 36, the swivel 24, and the kelly 26. The drilling fluid 32 exits near the bottom of the drill string 16 (e.g., at the drill bit 20) and returns to the surface through the annulus 38 between the wellbore and the drill string 16. A return conduit 40 transmits the returning drilling fluid 32 away from the well 14. In some embodiments, the returning drilling fluid 32 is cleansed (e.g., via one or more shale shakers, desanders, or desilters) and reused in the well 14.

In addition to the drill bit 20, the bottomhole assembly 18 also includes a downhole tool with various instruments that measure information of interest within the well 14. For example, as depicted in FIG. 1, the bottomhole assembly 18 includes a logging-while-drilling (LWD) module 44 and a measurement-while-drilling (MWD) module 46. Both modules include sensors, housed in drill collars, that collect data and enable the creation of measurement logs in real-time during a drilling operation. The modules could also include memory devices for storing the measured data. The LWD module 44 includes sensors that measure various characteristics of the rock and formation fluid properties within the well 14. Data collected by the LWD module 44 could include measurements of formation pressure, gamma rays, resistivity, neutron porosity, formation density, sound waves, optical density, and the like. The MWD module 46 includes sensors that measure various characteristics of the bottomhole assembly 18 and the wellbore, such as orientation (azimuth and inclination) of the drill bit 20, torque, shock and vibration, the weight on the drill bit 20, and downhole temperature and pressure. The data collected by the MWD module 46 (or by other modules of the bottomhole assembly 18) can be used to control drilling operations. The bottomhole assembly 18 can also include one or more additional modules 48, which could be LWD modules, MWD modules, or some other modules. It is noted that the bottomhole assembly 18 is modular, and that the positions and presence of particular modules of the assembly could be changed as desired.

The bottomhole assembly 18 can also include other modules. As depicted in FIG. 1 by way of example, such other modules include a power module 50, a steering module 52, and a communication module 54. In one embodiment, the power module 50 includes a generator (such as a turbine) driven by flow of drilling mud through the drill string 16. In other embodiments, the power module 50 could also or instead include other forms of power storage or generation, such as batteries or fuel cells. The steering module 52 may include a rotary-steerable system that facilitates directional drilling of the well 14. The communication module 54 enables communication of data (e.g., data collected by the LWD module 44 and the MWD module 46) between the bottomhole assembly 18 and the surface. In one embodiment, the communication module 54 communicates via mud pulse telemetry, in which the communication module 54 uses the drilling fluid 32 in the drill string as a propagation medium for a pressure wave encoding the data to be transmitted.

The drilling system 10 also includes a monitoring and control system 56. The monitoring and control system 56 can include one or more computer systems that enable monitoring and control of various components of the drilling system 10. The monitoring and control system 56 can also receive data from the bottomhole assembly 18 (e.g., data from the LWD module 44, the MWD module 46, and the additional module 48) for processing and for communication to an operator, to name just two examples. While depicted on the drill floor 30 in FIG. 1, it is noted that the monitoring and control system 56 could be positioned elsewhere, and that the system 56 could be a distributed system with elements provided at different places near or remote from the well 14.

Figure 2:
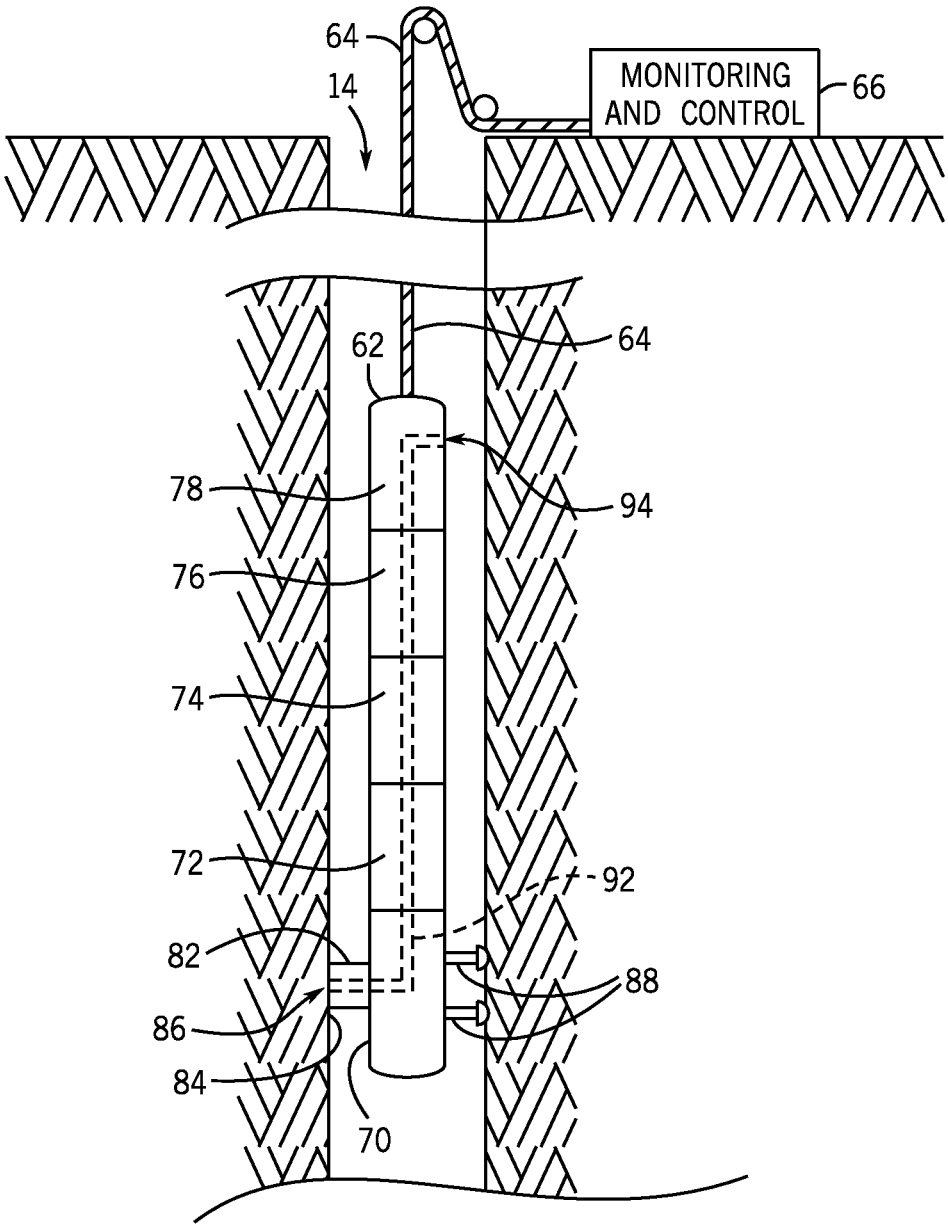
FIG. 2 generally depicts a testing tool deployed within a well on a wireline in accordance with one embodiment.

Another example of using a downhole tool for formation testing within the well 14 is depicted in FIG. 2. In this embodiment, a testing tool 62 is suspended in the well 14 on a cable 64. The cable 64 may be a wireline cable with at least one conductor that enables data transmission between the testing tool 62 and a monitoring and control system 66. The cable 64 may be raised and lowered within the well 14 in any suitable manner. For instance, the cable 64 can be reeled from a drum in a service truck, which may be a logging truck having the monitoring and control system 66. The monitoring and control system 66 controls movement of the testing tool 62 within the well 14 and receives data from the tool 62. In a similar fashion to the monitoring and control system 56 of FIG. 1, the monitoring and control system 66 may include one or more computer systems or devices and may be a distributed computing system. The received data can be stored, communicated to an operator, or processed, for instance. While the testing tool 62 is here depicted as being deployed by way of a wireline, in some embodiments the tool 62 (or at least its functionality) is incorporated into or as one or more modules of the bottomhole assembly 18 of the drill string 16, such as the LWD module 44 or the additional module 48.

The testing tool 62 can take various forms. While it is depicted in FIG. 2 as having a body including a probe module 70, a fluid analysis module 72, a pump module 74, a power module 76, and a fluid storage module 78, the testing tool 62 may include different modules in other embodiments. The probe module 70 includes a probe 82 that may be extended (e.g., hydraulically driven) and pressed into engagement against a wall 84 of the well 14 to hydraulically couple the probe to a formation and to draw fluid from the formation into the testing tool 62 through an intake 86. As depicted, the probe module 70 also includes setting pistons 88 that may be extended outwardly to engage the wall 84 and push the end face of the probe 82 against another portion of the wall 84. In some embodiments, the probe 82 includes a sealing element or packer that isolates the intake 86 from the rest of the wellbore. In other embodiments, the testing tool 62 could include one or more inflatable packers that can be extended from the body of the tool 62 to circumferentially engage the wall 84 and isolate a region of the well 14 near the intake 86 from the rest of the wellbore. In such embodiments, the extendable probe 82 and setting pistons 88 could be omitted and the intake 86 could be provided in the body of the testing tool 62, such as in the body of a packer module housing an extendable packer. Further, in certain embodiments, the intake may be provided within a packer (e.g., as a drain within a single packer) that can be expanded to press the intake against the wall 84.

The pump module 74 draws fluid from the formation into the intake 86, through a flowline 92, and then either out into the wellbore through an outlet 94 or into a storage container (e.g., a bottle within fluid storage module 78) for transport back to the surface when the testing tool 62 is removed from the well 14. The fluid analysis module 72 includes one or more sensors for measuring properties of the drawn formation fluid (e.g., fluid density, optical density, and pressure) and the power module 76 provides power to electronic components of the testing tool 62.

The drilling and wireline environments depicted in FIGS. 1 and 2 are examples of environments in which a testing tool may be used to facilitate analysis of a downhole fluid. The presently disclosed techniques, however, could be implemented in other environments as well. For instance, the testing tool 62 may be deployed in other manners, such as by a slickline, coiled tubing, or a pipe string.

Figure 3:
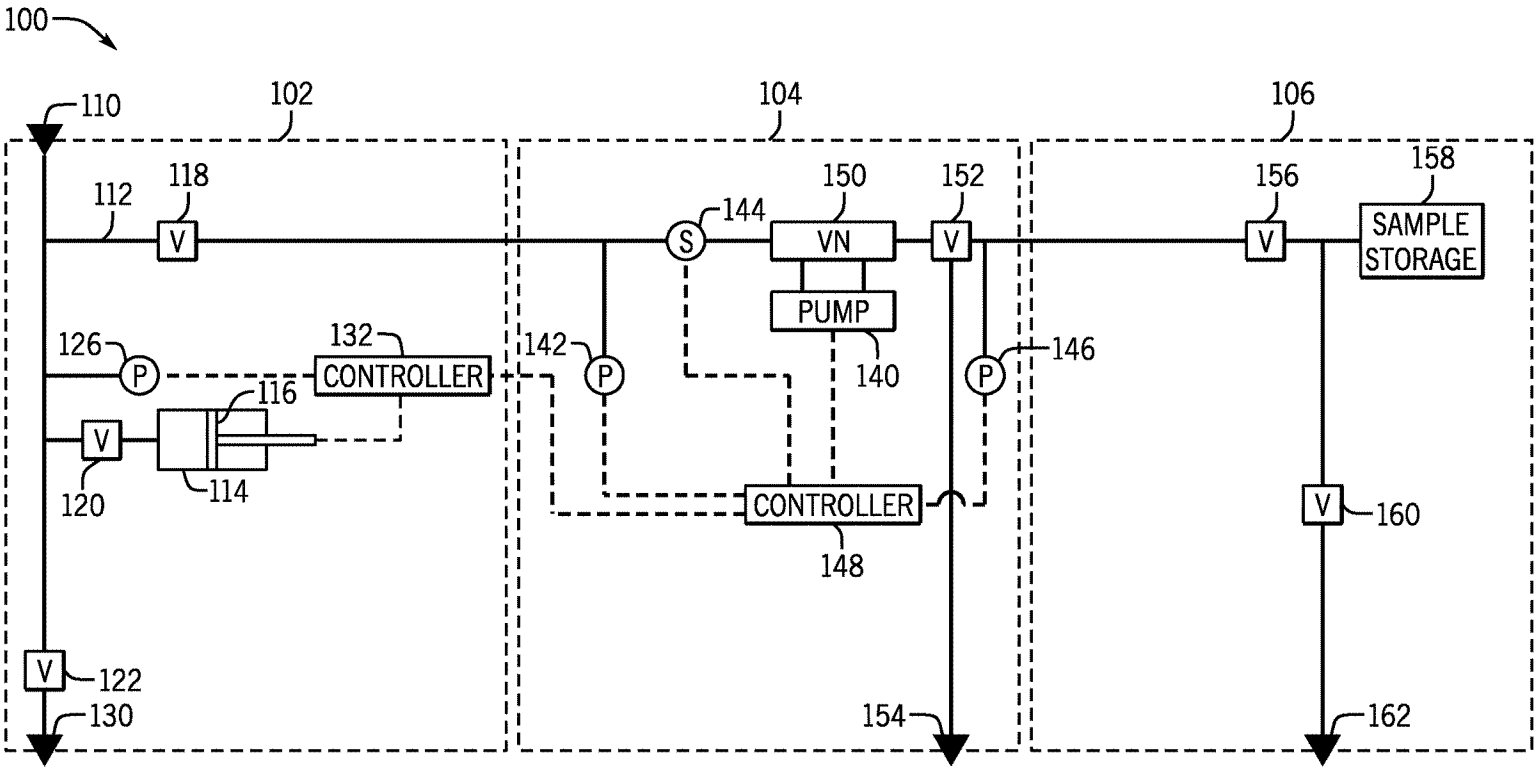
FIG. 3 is a block diagram of components of a testing tool in accordance with one embodiment.

As noted above, the testing tool 62 can take various forms. In one embodiment, generally depicted in FIG. 3 as a testing tool 100 (which may also be referred to as a sampling tool), the tool includes a probe module 102, a combined pump-analysis module 104, and a fluid storage module 106. The probe module 102 includes an intake 110, which can be provided in an extendable probe as described above with respect to FIG. 2. The intake 110 allows fluid to be drawn from a formation into a flowline 112 of the tool 100. The probe module 102 can include various components. As presently depicted, the probe module 102 includes a pressure test chamber 114 (which may also be referred to as a pretest chamber), a pump 116, a flowline isolation valve 118, a pretest isolation valve 120, an exhaust valve 122, and a pressure gauge 126, although in other embodiments the probe module 102 could include other components in addition to or in place of those generally illustrated in FIG. 3.

The tool 100 can be used to measure formation pressure by placing the intake 110 in fluid communication with the formation while isolating the intake 110 from wellbore pressure (e.g., through sealing engagement of the extendable probe against the wellbore). The pump 116 is then actuated to draw fluid into the flowline 112 and the pressure test chamber 114. Particularly, in the presently depicted embodiment, the pump 116 is provided in the form of a piston positioned within the pressure test chamber 114. With the intake 110 isolated from wellbore pressure, the flowline isolation valve 118 and the exhaust valve 122 closed, and the pretest isolation valve 120 open, the piston of pump 116 can be retracted to increase the volume of the pressure test chamber 114. As the piston is retracted in this manner, the pressure at the intake 110 falls. Once this pressure falls sufficiently below the formation pressure (in order to breach mud cake formed on the wellbore face), fluid flows from the formation into the tool 100 via the intake 110. The piston of pump 116 can then be stopped and fluid pressure within the pressure test chamber 114 increases toward equilibrium with the formation pressure as fluid from the formation passes into the tool 100 via the intake 110. The resulting pressure of the pressure test chamber 114 can then be read via the pressure gauge 126.

The depicted probe module 102 also includes a controller 132 for operating various components of the probe module.

The controller 132 could operate such components directly or in conjunction with other components or systems, such as a hydraulic control system for actuating hydraulic components. The controller 132 can also receive pressure measurements taken by the pressure gauge 126 and use those measurements in controlling operation of the probe module 102. For example, the controller 132 can command the pump 116 to begin operating to lower the pressure within the tool (e.g., by retracting a piston in the pressure test chamber 114), detect a pressure increase (via pressure gauge 126) in the tool indicative of formation fluid breaching the mud cake and flowing into the tool 100, and then command that the pump 116 stop to allow the pressure within the pressure test chamber 114 reach equilibrium with the formation from which the fluid is drawn. The controller 132 can also command the pump 116 to expel fluid from the chamber 114 and can control the rate at which the pump 116 operates.

Also, the controller 132 can command operation of the valves 118, 120, and 122 either directly (in the case of electromechanical valves) or via a hydraulic system (in the case of hydraulically actuated valves). The flowline isolation valve 118 can be an independently controlled valve, such as a solenoid valve actuated by the controller 132 to selectively isolate other modules of the tool 100 from the intake 110. The pretest isolation valve 120 can be opened by the controller 132 to permit fluid communication between the pressure test chamber 114 and the flowline 112, and the exhaust valve 122 can be opened to allow fluid to be expelled into the wellbore via an outlet 130.

The module 104 is depicted as including a pump 140, a pressure gauge 142 upstream from the pump 140, additional sensors 144, a pressure gauge 146 downstream from the pump 140, a controller 148, a valve network 150 for controlling flow to and from the pump 140, and another valve 152. The pump 140 is operable to route fluid through the tool 100 via the flowline 112 when the flowline isolation valve 118 is open. In one embodiment described in greater detail below with respect to FIG. 5, the pump 140 is a dual-acting reciprocating pump in which a shared rod drives two pistons in separate chambers such that movement of the shared rod in one direction causes a suction stroke in a first chamber and a discharge stroke in a second chamber. The direction of the shared rod can be reversed to then cause a discharge stroke in the first chamber and a suction stroke in the second chamber. In other embodiments, the pump 140 can be provided in different forms. Further, the pump 140 can be driven in any suitable manner. For example, in some embodiments the pump is driven by an electric motor via a screw actuator.

With the valve 118 opened, operation of the pump 140 creates a pressure differential between the formation hydraulically coupled to the intake 110 and the flowline 112 upstream of the pump 140. This generally causes fluid to flow from the formation into the flowline 112 and to be routed through the tool 100 by operation of the pump 140. The fluid pumped out of the pump 140 can be routed out into the wellbore via outlet 154 or, if desired, directed to the fluid storage module 106 by the valve 152 to enable collection of a sample of the fluid. With fluid being routed through the tool 100 by the pump 140, properties of the fluid can be measured via the pressure gauges 142 and 146 and the additional sensors 144. The additional sensors 144 can include any suitable sensors and may be used to take additional measurements related to fluid routed through the tool 100. These additional measurements could include temperature, fluid density, optical density, electrical resistivity, fluorescence, and contamination, to name but a few examples. While the module 104 is depicted as including both pumping and analytical functionality, it will be appreciated that the additional sensors 144 could instead be provided in a separate module (e.g., another fluid analysis module) of the tool 100. Likewise, either or both of the pressure gauges 142 and 146 could also be located elsewhere within the tool 100.

The controller 148 directs operation (e.g., by sending command signals) of the pump 140 to control the flow of fluid routed through the tool by the pump 140. The controller 148 can, for example, initiate pumping by the pump 140 to begin routing formation fluid from the intake 110 through the tool 100 and vary the rate at which the pump 140 operates to control flow characteristics of the routed fluid. The controller 148 can also receive data from the pressure gauges 142 and 146 and the additional sensors 144. This data can be stored by the controller 148 or communicated to another controller or system for analysis. In at least one embodiment, the controller 148 also analyzes data received from the pressure gauges 142 and 146 or from the additional sensors 144. For example, the controller 148 can monitor outputs from the pressure gauges 142 and 146 and the additional sensors 144 to detect pumping anomalies within the tool 100.

The controller 148 could also vary operation of the pump 140 based on pressure measurements (e.g., from gauges 142 and 146) and could operate the valve 152 to divert fluid to storage devices 158 of the fluid storage module 106 based on analysis of the collected data indicating that collection of a fluid sample is desired. The storage devices 158 can include bottles or any other suitable vessels for retaining fluid samples for later retrieval at the surface. In at least some embodiments, the valve 156 is a check valve to inhibit back flow from the module 106 to the module 104, and the valve 160 is a pressure relief valve to enable fluid to vent from the module 106 to the wellbore via outlet 162 if the pressure exceeds a given threshold.

Figure 4:
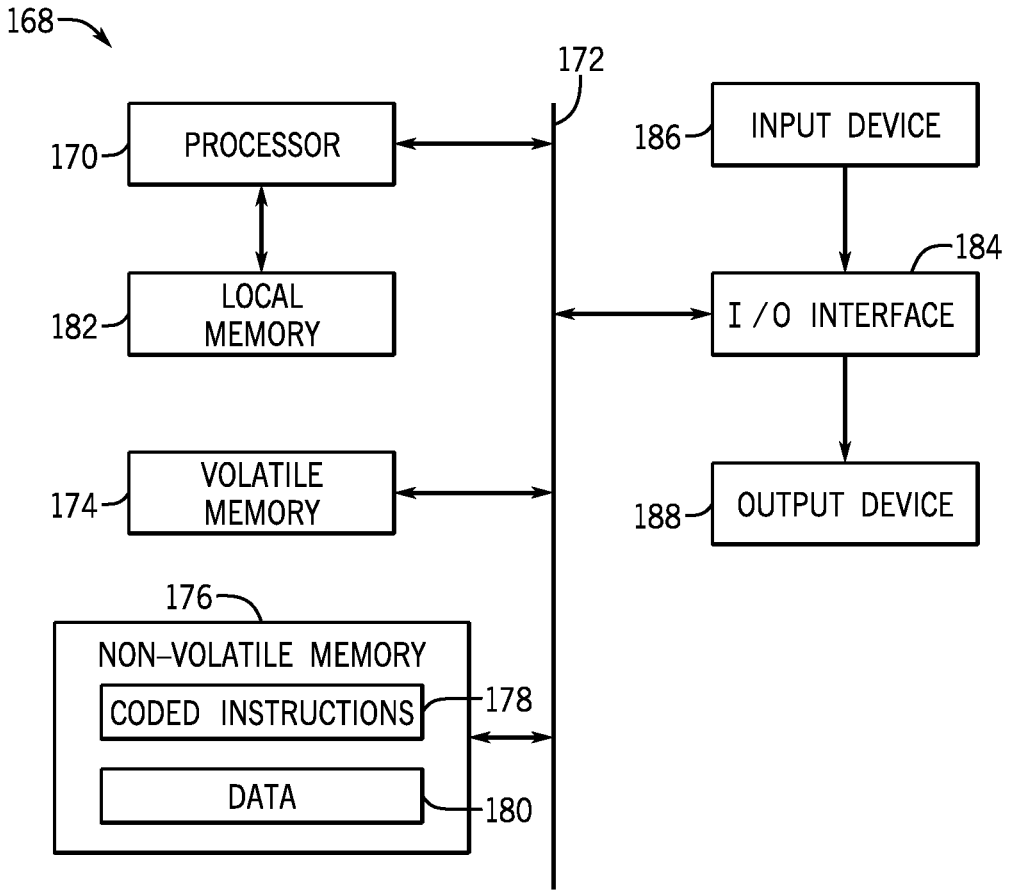
FIG. 4 is a block diagram of components in one example of a controller for the testing tool of FIG. 3.

The controllers 132 and 148 of at least some embodiments are processor-based systems, an example of which is provided in FIG. 4 and referred to as controller 168. In this depicted embodiment, the controller 168 includes at least one processor 170 connected, by a bus 172, to volatile memory 174 (e.g., random-access memory) and non-volatile memory 176 (e.g., flash memory and a read-only memory (ROM)). Data 180 and coded application instructions 178 (e.g., software that may be executed by the processor 170 to enable the control and analysis functionality described herein, including the detection of half-stroking and the determination of pumped fluid volume accounting for the effects of half-stroking) are stored in the non-volatile memory 176. For example, the application instructions 178 can be stored in a ROM and the data 180 can be stored in a flash memory. The instructions 178 and the data 180 may be also be loaded into the volatile memory 174 (or in a local memory 182 of the processor) as desired, such as to reduce latency and increase operating efficiency of the controller 168.

An interface 184 of the controller 168 enables communication between the processor 170 and various input devices 186 and output devices 188. The interface 184 can include any suitable device that enables such communication, such as a modem. In some embodiments, the input devices 186 include one or more sensing components of the tool 100 (e.g., pressure gauges or other sensors) and the output devices 188 include other components of the tool 100 (e.g., pumps and valves). The output devices 188 could also include displays, printers, and storage devices that allow output of data received or generated by the controller 168.

Figure 5:
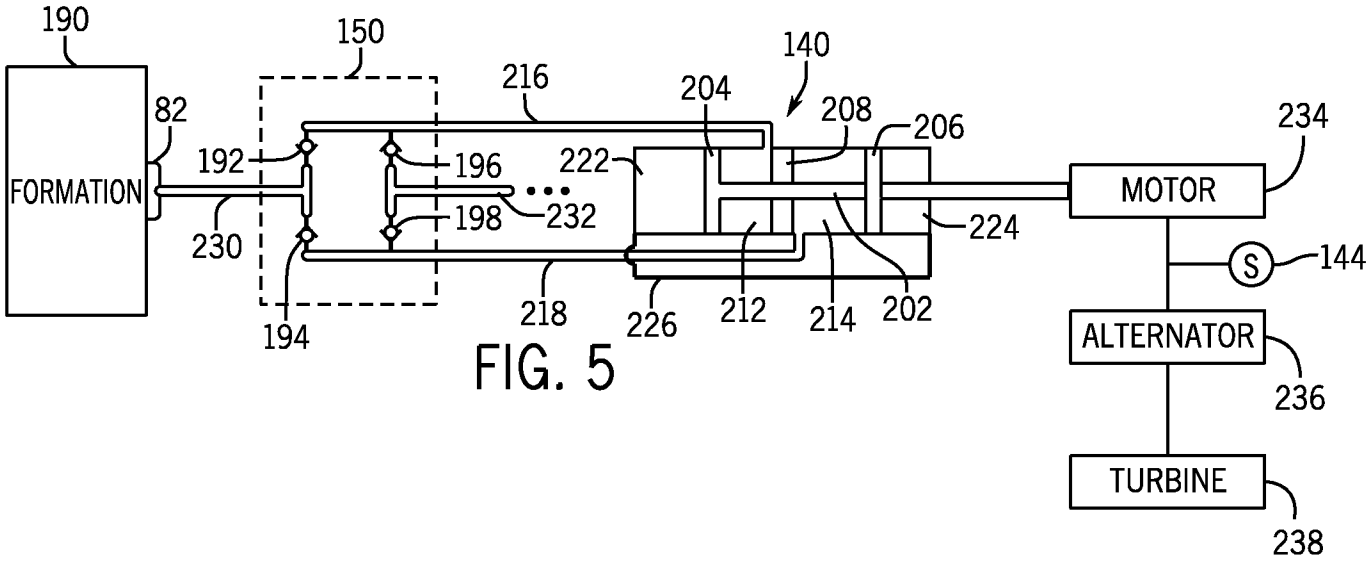
FIG. 5 depicts one example of a pump and a network of check valves that can be used in the testing tool of FIG. 3 for pumping fluid through the testing tool in accordance with one embodiment.

As noted above, in at least one embodiment the pump 140 is provided as a dual-acting reciprocating pump. An example of such a pump 140 and an associated valve network 150 is generally illustrated in FIG. 5 in accordance with one embodiment. In this specific example, the pump 140 is depicted as a bidirectional positive displacement pump for pumping fluid from a formation 190 via a probe 82, and the valve network 150 is depicted as having check valves 192, 194, 196, and 198. The check valves 192 and 194 are connected to an inlet line 230, while the check valves 196 and 198 are connected to an outlet line 232 (e.g., toward valve 152 in FIG. 3). These check valves collectively operate to control flow of fluid to and from the pump 140.

The depicted pump 140 includes a shared rod 202 with pistons 204 and 206 on opposite sides of a divider 208. The volumes of displacement unit chambers 212 and 214 within the pump 140 change as the rod 202 and pistons 204 and 206 reciprocate, which generally causes one of these chambers to draw fluid in while causing the other of these chambers to expel fluid. More specifically, as the rod 202 is moved to the left, the volume of the chamber 212 (between the piston 204 and the divider 208) increases and the volume of the chamber 214 (between the piston 206 and the divider 208) decreases. It will be appreciated that wells are often kept in an overbalanced state, in which wellbore pressure exceeds the formation pressure to inhibit hydrocarbons or other fluids from flowing into the well, during drilling and sampling operations. The increase in the volume of the chamber 212 causes the pressure within this chamber to decrease (also known as the drawdown pressure) below the formation pressure, resulting in pressure decreases within a connecting line 216 and the inlet line 230 and in formation fluid being drawn into the chamber 212 via the inlet line 230, the check valve 192, and the connecting line 216. At the same time, the decrease in the volume of the chamber 214 increases pressure within the chamber 214, a connecting line 218, and the outlet line 232 above the wellbore pressure, causing fluid within the chamber 214 to be expelled out the connecting line 218, through check valve 198, and out of the tool 100 into the wellbore via the outlet line 232.

Once the rod 202 reaches the end of its axial travel to the left, the rod 202 can be moved in the opposite axial direction (i.e., to the right in FIG. 5). This, in essence, switches the operation of the chambers 212 and 214. That is, as the rod 202 moves to the right, the volume of the chamber 212 decreases to increase pressure within and expel fluid from the chamber 212 (through the connecting line 216, the check valve 196, and the outlet line 232) and the volume of the chamber 214 increases to decrease pressure within and draw fluid into the chamber 214 (through the inlet line 230, the check valve 194, and the connecting line 218). Slack chambers 222 and 224 are isolated from the chambers 212 and 214 by the pistons 204 and 206. These slack chambers 222 and 224 are connected together by a fluid line 226 and can be filled with a control fluid (e.g., hydraulic oil), which can be pushed back and forth between the slack chambers by movement of the pistons 204 and 206.

The rod 202 can be moved within the pump 140 in any suitable manner. For instance, in some embodiments the rod is driven by a motor 234 via a screw actuator. As depicted in FIG. 5, the motor 234 is an electric motor that draws current from an alternator 236 driven by a turbine 238 (e.g., a mud turbine of power module 50). An additional sensor 144 can be connected as shown in FIG. 5 to measure alternator current drawn by the motor 234. In another embodiment, the pump can be driven hydraulically by controlling the hydraulic pressures in the chambers 222 and 224.

During normal operation of the pump 140 and the valve network 150 depicted in FIG. 5, the two working sides of the pump alternate between suction and discharge as described above. But if one of the check valves 192, 194, 196, or 198 ceases to check fluid (e.g., from debris caught between a poppet and seat of the check valve), one of the displacement chambers 212 and 214 could become inactive. That is, it would not produce fluid from the formation and, at the same time, would not pump fluid into the wellbore. Such a condition is known as half-stroking. In some instances in which multiple check valves cease to check fluid, both displacement chambers 212 and 214 could become inactive even with continued motion of the rod 202 (i.e., a condition known as no-stroking).

Figure 6:
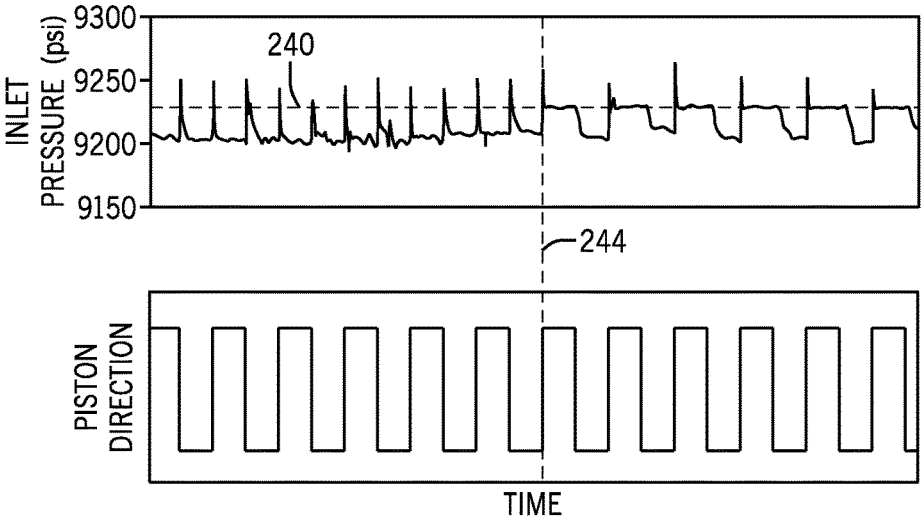
FIG. 6 graphically depicts inlet pressure and displacement piston direction for a pumping system, and also shows the onset of half-stroking, in accordance with one embodiment.

By way of example, FIG. 6 depicts inlet pressure and the direction of the piston assembly (rod 202, piston 204, and piston 206) during pumping before and after the onset of half-stroking by the pump 140. The pressure response depicted in the upper subplot can be measured with the pressure gauge 142. The time of onset of half-stroking by the pump 140 is represented by line 244 in FIG. 6 (with normal operation represented to the left of the line 244 and half-stroking operation represented to the right of the line 244). As shown in this figure, during normal operation the inlet pressure generally remains below the formation pressure (represented here by line 240). Although not presently depicted, it will also be appreciated that the outlet pressure downstream of the pump generally remains above the wellbore pressure, allowing the expelled fluid to flow from the tool into the wellbore.

The lower subplot depicts a square wave-shaped curve that represents the direction of the reciprocating motion of the piston assembly, which alternates between forward and reverse strokes for pumping fluid through the tool. When one of the pistons 204 and 206 reaches either end of the chambers 212 or 214, the piston assembly will stop momentarily as it reverses direction. This causes the transitory "spike" features depicted during normal operation in FIG. 6 (i.e., the inlet pressure rising toward the formation pressure). As depicted in FIG. 6, the piston assembly moves in a periodic manner when stroking from a first end to a second end and from the second end back to the first end (e.g., from right-to-left and then from left-to-right) such that the period of its movement is equal to the sum of the times for the forward and backward strokes. In some embodiments, the travel speed of the piston assembly is the same for both forward and reverse strokes. In other embodiments, however, these strokes can be asymmetric and vary in speed, with strokes in one direction being completed faster than strokes in the other direction.

As noted above, half-stroking begins at a time represented by line 244 in FIG. 6. This pumping anomaly can be recognized by the inlet pressure response. In this half-stroking condition, during one stroke the inlet pressure drops in response to producing fluid from the formation, as is the case with normal operation. During the opposite stroke, however, the inlet pressure does not show the same response because one check valve is not functioning properly. Consequently, the inlet pressure remains at about the formation pressure during the opposite stroke. Half-stroking can be diagnosed based on the alternating pattern of the inlet pressure signal between normal and anomalous levels. Further, while not depicted in FIG. 6, a no-stroking condition can be diagnosed based on the inlet pressure signal remaining at anomalous levels during consecutive (i.e., forward and back) strokes of the pump, rather than alternating between the anomalous and normal levels with each stroke.

As generally noted above, the volume of fluid that has been pumped from a formation up to a given time can be used to estimate the contamination level of the pumped fluid at the given time or to predict the contamination level at some later time. The volume of fluid that has been pumped from the formation can also be used to predict an amount of additional time until the pumped fluid will reach a desired level of contamination. For normal operation of the pump, the volume of the fluid drawn from the formation by the pump can be calculated from pump displacement. In the event of half-stroking (or no-stroking), however, calculating the volume of the fluid drawn from the formation in this same way would overestimate the fluid that is actually drawn. Further, such errors in the calculated volume of the drawn fluid can result in decreased accuracy in estimates of contamination level and predictions of when a desired contamination level will be reached. Accordingly, in at least some embodiments the occurrence of half-stroking is detected and the effects of half-stroking are accounted for during the calculation of the pumped volume from the formation. This can improve the accuracy of the estimates of pumped volume, as well as the accuracy of estimates regarding other parameters based on the pumped volume (e.g., parameters relating to fluid contamination level).

Figure 7:
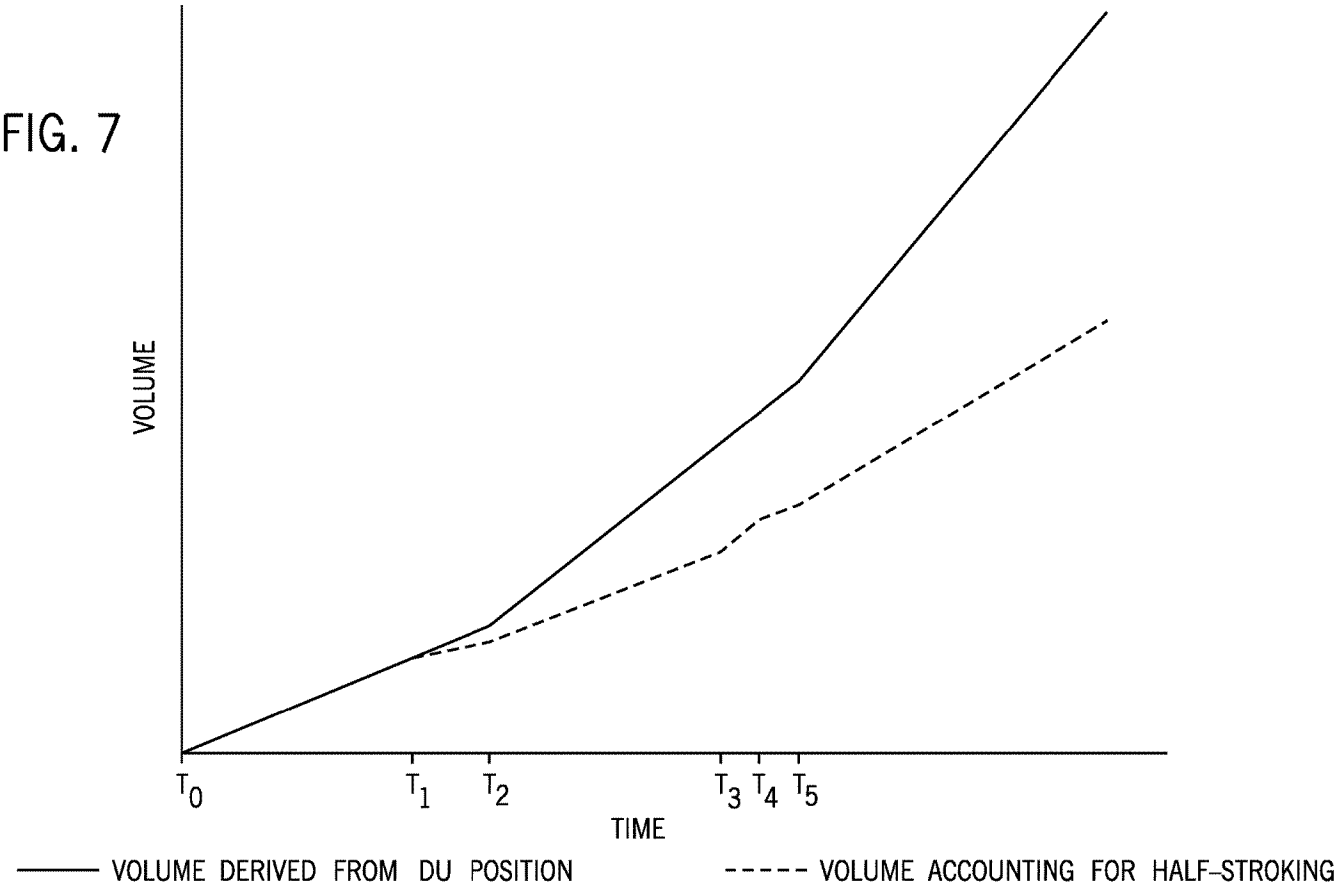
FIG. 7 is a graph representing refinement of the computation of the volume of fluid drawn from a formation by accounting for the effects of half-stroking in accordance with one embodiment.

An example of calculations of fluid volume pumped from a formation during a testing operation is generally depicted in FIG. 7. In this graph, the volume of the pumped fluid calculated based on pump displacement (from displacement unit (DU) position) without accounting for the effects of half-stroking is represented by the solid, upper plot line. In contrast, the dashed, lower plot line represents a calculated volume of the pumped fluid that accounts for the effects of half-stroking.

In this depicted example, and as will be understood with reference to the solid, upper plot line, the pump operates at a first speed and starts to draw fluid from the formation at time $T_0$. At time $T_2$ the pump speed is increased (e.g., to twice the first speed), which corresponds to an increased slope in the upper plot line. At time $T_5$ the pump speed is increased again (e.g., to three times the first speed), corresponding to a further increase in the slope of the upper plot line.

As noted above, half-stroking by the pump can reduce the volume of fluid pumped from a formation over a given period of time. The effects of half-stroking on the volume of fluid pumped from the formation are generally represented by the difference in the upper and lower plot lines in FIG. 7. In this example, half-stroking begins at time $T_1$ and ends briefly at time $T_3$ before beginning again at time $T_4$. The half-stroking between times $T_1$ and $T_3$, and from $T_4$ onward, causes the volume of fluid pumped from the formation to be less than would be expected during normal operation. In accordance with certain embodiments, half-stroking periods can be automatically identified by a controller based on data (e.g., inlet pressure) measured by a downhole tool and the calculated volume of fluid pumped from a formation can be adjusted for the effects of half-stroking. This volume can then be used for further analysis, such as contamination estimation.

Figure 8:
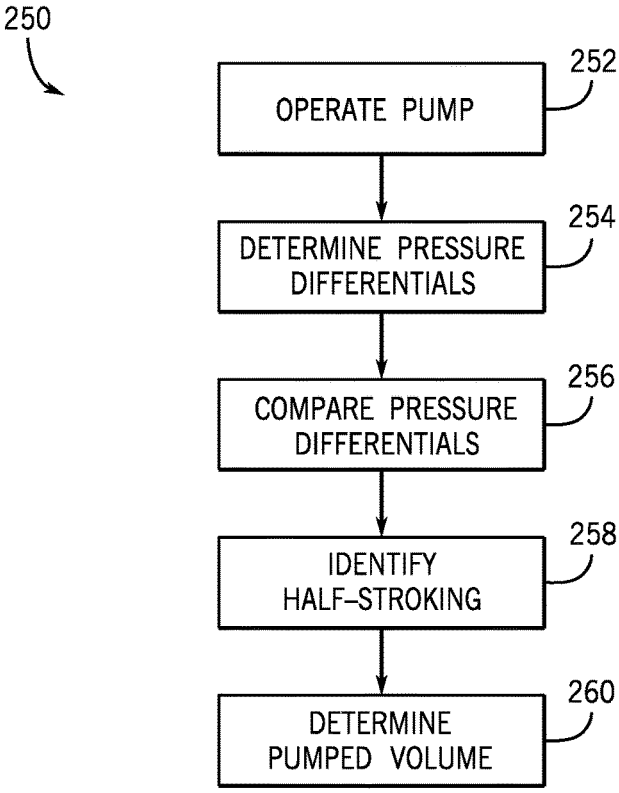
FIGS. 8 and 9 are flow charts representing methods for identifying the onset of half-stroking during pump operation and determining the volume of fluid pumped from a source in accordance with certain embodiments.

With the foregoing in mind, one example of a process for identifying half-stroking and determining the volume of fluid pumped from the formation is generally represented by flow chart 250 in FIG. 8. In this example, a pump (e.g., pump 140) is operated to pump fluid from a formation or some other pressurized source, as represented at block 252. The pump can be operated in any suitable manner, including that described above for the dual-acting reciprocating pump 140. In at least some embodiments, the pump is integrated into a downhole tool within a well and is operated to pump fluid from a formation through the downhole tool, although the present techniques can be applied to pumps in non-wellbore or non-oilfield contexts in other embodiments.

The pressure of the drawn fluid within the tool (e.g., in flowline 112) can be measured (e.g., by pressure gauge 126 or 142) and used to determine pressure differentials (block 254) between the formation pressure and the pressure of the drawn fluid within the tool. These pressure differentials can then be compared (block 256) to enable identification of half-stroking (block 258) and used in determining the volume of fluid pumped from the formation (block 260). The pressure measurements of the fluid in the tool may be taken continually (such as at a set sampling rate) over a period of time during pumping. In at least some embodiments the pressure differentials for consecutive strokes are aggregated (e.g., summed) by stroke and the aggregated pressure differentials for the strokes are then compared to one another to identify the beginning or ending of half-stroking by the pump, as described in greater detail below with respect to FIG. 9. It is again noted that the inlet pressure in the tool upstream from the pump generally remains below the formation pressure for both forward and reverse strokes during normal operation. During half-stroking, however, the inlet pressure instead remains nearer the formation pressure for either the forward or the reverse strokes, while the inlet pressure remains below the formation pressure for the other strokes. This creates an alternating pattern in the inlet pressure response of a half-stroking pump. Consequently, sufficiently high differences between the determined pressure differentials for consecutive strokes suggest half-stroking operation by the pump.

In some embodiments the determination of pressure differentials, the comparison of the pressure differentials, the identification of half-stroking, and the determination of the volume of fluid pumped from the formation are performed downhole at the tool (e.g., in real-time by controller 148). In other cases, however, one or more of these actions can be performed remote from the tool, such as at the surface. Results obtained at the tool can be communicated to the surface via mud pulse telemetry or in any other suitable fashion.

Figure 9:
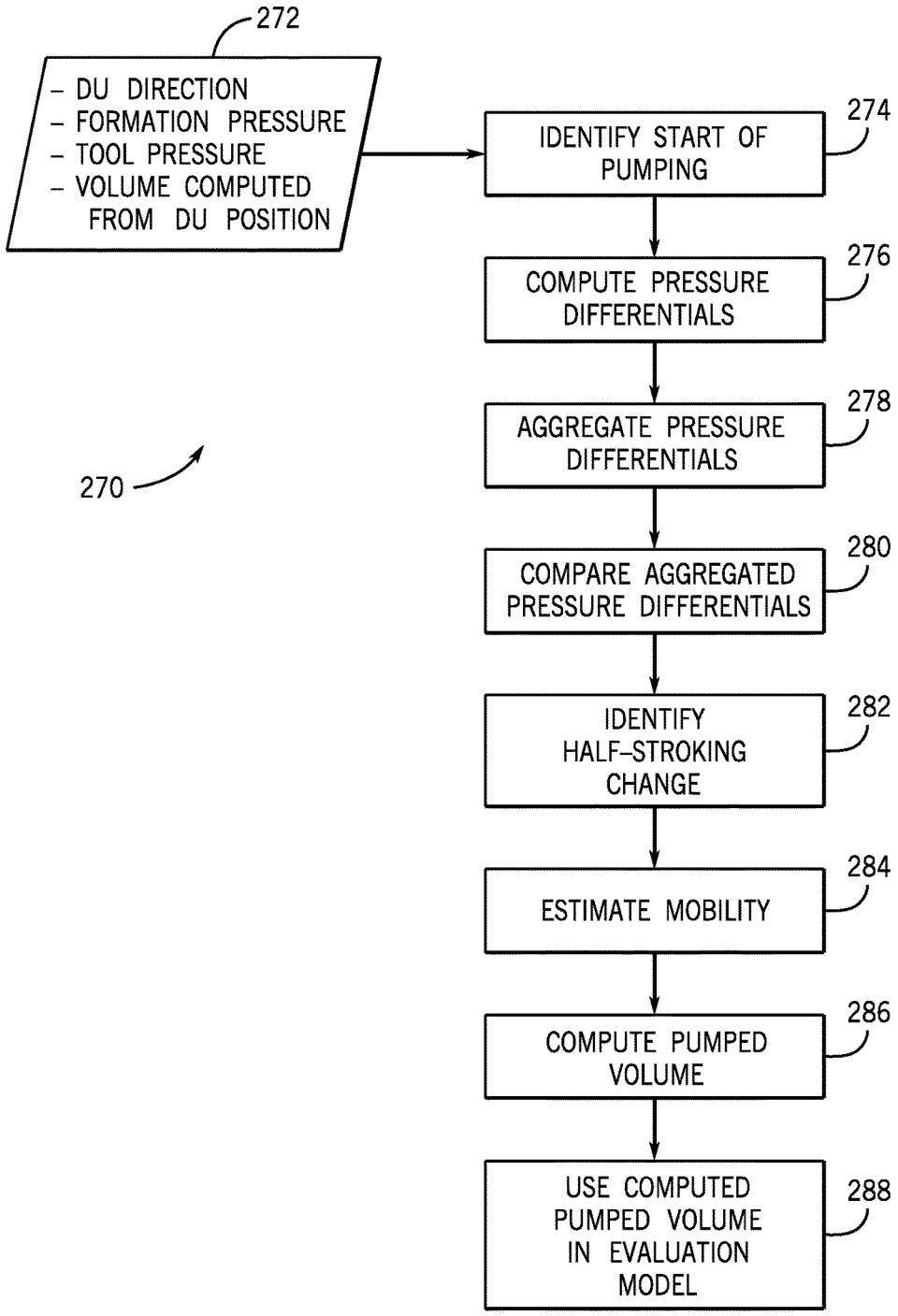

Another example of a process for identifying half-stroking and determining the volume of fluid pumped from a formation is generally represented by flow chart 270 in FIG. 9. This example uses various data 272 as inputs to the process. The input data can include inlet pressure in the tool, also referred to herein as probe pressure p(t); the formation pressure, $P_f$; displacement unit (DU) direction (e.g., the direction of the piston assembly of the pump 140); and the pumped volume, V(t), computed from the position of the displacement unit. In one embodiment, the displacement unit direction is represented by an array, referred to herein as the DUDir array, having entries of −1 and 1 indicating the direction of the displacement unit. After calibration during the first stroke of the displacement unit, the DUDir array can take on the values −1. If the DUDir array has missing values, the array can be repaired by considering neighboring values and filling-in the missing values with the appropriate values of −1 and 1 (in view of the neighboring values).

The start of pumping can be identified (block 274), such as by finding the first instance in which the probe pressure falls below the formation pressure. Pressure differentials between the formation pressure and the probe pressure can then be computed (block 276) according to:

$$\Delta p(t_n)=P_f-p(t_n),\ n=1,\ldots,n\text{Data}$$

These pressure differentials can be aggregated (block 278) and then compared (block 280) to identify changes in half-stroking operation (block 282), such as the onset or cessation of half-stroking. This process can include, for example, finding the times, $t_{n(k)}$, at which the displacement unit changes direction and then computing for each index, k, the area, A(k), contained between the probe pressure and the formation pressure during a single stroke of the displacement unit. This area between the probe and formation pressures can be computed in any suitable manner. For example, the pressure differentials for a stroke can be aggregated by integrating the difference between the probe and formation pressures over the time of the stroke:

$$A(k)=\int_{t_{n(k-1)}}^{t_{n(k)}}\Delta p(x)dx$$

While this integration is a form of summation, it is noted that the area could be computed in other ways, including other forms of summation. For example, the area between the probe and formation pressures for each of a series of alternating (forward and reverse) strokes could be estimated using Riemann sums based on the determined pressure differentials. In another instance, pressure differentials for each stroke can be averaged and then multiplied by the elapsed time of the stroke to estimate the area.

Once areas between the probe and formation pressures are determined, the areas for consecutive strokes can be compared to identify the beginning or ending of half-stroking. For instance, k* can be found such that $A(k^*)<\alpha A(k^*-1)$, where $\alpha$ is a predetermined threshold that is suitably small, such as 0.25 or less. That is, the process can be used to find instances in which the ratio of the pressure differential area of one stroke to that of the previous stroke is below the predetermined threshold level, $\alpha$. It will be appreciated that the process could instead find instances in which the ratio of the pressure differential areas of the earlier stroke to the later stroke is greater than a different threshold level (e.g., the inverse of $\alpha$). The beginning of half-stroking can be detected as the index $n(k^*-1)$. If no suitable index can be found, $n(k^*-1)$ can be set equal to nData. It is noted that this technique implicitly assumes that no-stroking is not occurring at the beginning of pumping. In at least one embodiment, the pressure differentials (or areas) of consecutive strokes near the beginning of pumping can be compared to an expected level to confirm that no-stroking is not occurring at the outset. To determine the end of half-stroking periods, $k^o$ can be found such that $A(k^o-1)-A(k^o)|<\alpha A(k^o)$ and $A(k)>(1-\alpha)A^*$, where $A^*=A(k^*-1)$ and the end of half-stroking is detected as the index $n(k^o-1)$. If no such index exists, $n(k^o-1)$ can be set equal to nData.

The process represented in flow chart 270 also includes determining mobility (block 284) and using the determined mobility to then determine the volume of fluid pumped from the formation (block 286). In some instances, this can include computing real-time estimates of mobility for each of a series of consecutive pump strokes. The mobility can be computed in any appropriate manner. In one embodiment, the mobility can be determined from a pressure test conducted before the pump 140 begins pumping fluid from the formation (e.g., using pretest chamber 114). In another embodiment, an estimate of the real-time mobility during each stroke can be computed according to:

$$M(k)=C(V(n(k))-V(n(k-1)))/A(k),$$

where C is a constant that varies according to physical characteristics of the tool and the well and can be determined by those skilled in the art through known techniques. For times before than the beginning of half stroking, $t_{n(k^*-1)}$, the computed volume of fluid pumped from the formation, $V_{HS}(t)$, can be set equal to the volume of fluid displaced by the pump, V(t). For times after the beginning of half-stroking, the volume of fluid pumped from the formation can be computed as:

$$V_{HS}(n(k))=V_{HS}(n(k-1))+M^oA(k)/C,$$

where $M^o$ is a mobility computed for a time during operation of the pump before the onset of half-stroking. For example, the computed mobility can be an average mobility for multiple strokes of the pump preceding the onset of half-stroking (e.g., an average mobility for two or three consecutive strokes immediately preceding the detected onset of half-stroking). For computing volumes for intermediate times during strokes of the displacement unit, the volumes can be interpolated from the volumes $V_{HS}(n(k-1))$ at the beginning of the stroke and $V_{HS}(n(k))$ at the end of the stroke.

The computed pumped volume of fluid drawn from the reservoir can then be used in an evaluation model (block 288) to estimate other parameters, such as to make estimates of the contamination level of fluid drawn from the formation at any point during the sampling operation. For instance, in one embodiment the computed volume and tool-measured optical densities, $\Omega(t)$, of the drawn fluid can be used to determine model parameters of an appropriate property evolution model, such as:

$$\Omega(t)=\Omega_o-\beta V_{HS}(t)^{-\gamma}$$

The model parameters $\Omega_o$, $\beta$ and $\gamma$ may be determined by fitting the model to the measured data by a weighted least-squares or maximum likelihood method, for instance. The contamination level may then be estimated, such as by computing the contamination level according to:

$$v(t)=\frac{\beta}{\Omega_o-\Omega_f}V_{HS}(t)^{-\gamma}$$

where $\Omega_f$ is a property of the contaminating fluid, which can be taken to be close to 0 or determined through known techniques. The use of an improved computation of the pumped volume that accounts for the effects of half-stroking, such as described above, can enable increased accuracy in the estimation of contamination levels or other parameters that depend on the pumped volume.

The foregoing outlines features of several embodiments so that those skilled in the art may better understand aspects of the present disclosure. Those skilled in the art should appreciate that they may readily use the present disclosure as a basis for designing or modifying other processes and structures for carrying out the same purposes or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A method comprising:

operating a pump of a downhole tool to pump fluid from a formation through the downhole tool;

determining pressure differentials between a formation pressure and pressure of the fluid within the downhole tool;

summing pressure differentials between the formation pressure and the pressure of the fluid within the downhole tool for a forward stroke of the pump;

summing pressure differentials between the formation pressure and the pressure of the fluid within the downhole tool for a reverse stroke of the pump;

comparing the summed pressure differentials for the forward stroke to the summed pressure differentials for the reverse stroke to enable identification of onset of half-stroking by the pump;

calculating mobility; and determining volume of the fluid pumped through the downhole tool during half-stroking by the pump based on calculated mobility and the compared pressure differentials.

2. The method of claim 1, comprising identifying the onset of half-stroking by the pump through the comparison of the summed pressure differentials for the forward stroke to the summed pressure differentials for the reverse stroke.

3. The method of claim 2, wherein identifying the onset of half-stroking includes:

determining that a ratio of the summed pressure differentials for the later of the forward stroke or the reverse stroke to the summed pressure differentials for the earlier of the forward stroke or the reverse stroke is below one predetermined threshold; or determining that a ratio of the summed pressure differentials for the earlier of the forward stroke or the reverse stroke to the summed pressure differentials for the later of the forward stroke or the reverse stroke is above a different predetermined threshold.

4. The method of claim 1, wherein calculating mobility includes computing estimates of real-time mobility for strokes of the pump.

5. The method of claim 1, comprising using mobility computed for a time during operation of the pump before onset of half-stroking in determining the volume of the fluid pumped through the downhole tool during half-stroking.

6. The method of claim 5, wherein the mobility computed during operation of the pump before onset of half-stroking is an average of mobility computed for multiple strokes of the pump preceding the onset of half-stroking.

7. The method of claim 6, wherein the mobility computed during operation of the pump before onset of half-stroking is the average mobility computed for multiple consecutive strokes of the pump immediately preceding the onset of half-stroking.

8. The method of claim 1, comprising using the determined volume to estimate a level of contamination in the fluid.

9. The method of claim 1, comprising detecting the end of half-stroking by the pump through comparison of summed pressure differentials for an additional forward stroke of the pump and an additional reverse stroke of the pump.

10. The method of claim 1, wherein summing pressure differentials between the formation pressure and the pressure of the fluid within the downhole tool for the forward stroke of the pump and for the reverse stroke of the pump includes integrating the pressure differentials between the formation pressure and the pressure of the fluid within the downhole tool over respective time periods of the forward and reverse strokes.

11. A method comprising:

drawing fluid through a flowline from a pressurized source into a first chamber of a pump, and expelling fluid from a second chamber of the pump, by moving a piston of the pump in a first axial direction;

changing the direction of movement of the piston from the first axial direction to a second axial direction opposite the first axial direction;

drawing fluid through the flowline from the pressurized source into the second chamber of the pump, and expelling fluid from the first chamber of the pump, by moving the piston in the second axial direction;

monitoring flowline pressure of the fluid drawn from the source;

determining pressure differentials between the source and the flowline;

calculating mobility; and computing volume of fluid pumped by the pump based on the determined pressure differentials and calculated mobility.

12. The method of claim 11, wherein the pump is disposed in a downhole tool.

13. The method of claim 12, wherein the source is a formation and the method comprises estimating real-time mobility for fluid of the formation during movement of the piston in the first and second axial directions.

14. The method of claim 11, comprising:

integrating a pressure differential that exists, during movement of the piston in the first axial direction, between the source pressure and the flowline pressure;

integrating a pressure differential that exists, during movement of the piston in the second axial direction, between the source pressure and the flowline pressure; and comparing the results of the integration for the pressure differential existing during movement of the piston in the first axial direction and of the integration for the pressure differential existing during movement of the piston in the second axial direction to enable detection of half-stroking by the pump.

15. An apparatus comprising:

a downhole tool including:

an intake configured to receive formation fluid within a flowline of the downhole tool;

a pump in fluid communication with the flowline so as to enable the pump to draw the formation fluid into the downhole tool via the flowline and to expel the formation fluid from the downhole tool; and a sensor configured to measure formation fluid pressure within the flowline; and a controller operable to determine pressure differentials between a formation pressure and measured formation fluid pressure within the flowline, to compare aggregates of the pressure differentials for consecutive strokes of the pump, to identify onset of half-stroking by the pump based on the comparison of the aggregates of the pressure differentials for the consecutive strokes, to calculate mobility, and to compute volume of the fluid pumped through the downhole tool during half-stroking by the pump based on the determined pressure differentials and calculated mobility.

16. The apparatus of claim 15, wherein the controller is operable to account for effects of pump half-stroking in the computation of the volume of formation fluid pumped by the pump.

17. The apparatus of claim 15, wherein the pump includes a bidirectional displacement pump having a reciprocating piston and the consecutive strokes include a forward stroke and a reverse stroke of the reciprocating piston.

18. The apparatus of claim 15, wherein the downhole tool includes the controller.

* * * * *